US007102579B2

(12) United States Patent
Haaft et al.

(10) Patent No.: US 7,102,579 B2
(45) Date of Patent: Sep. 5, 2006

(54) SATELLITE ANTENNA WITH PHOTOVOLTAIC ELEMENTS FOR ELECTRIC POWER SUPPLY

(75) Inventors: Andreas ten Haaft, Königsbach-Stein (DE); Michael ten Haaft, Neulingen-Bauschlott (DE)

(73) Assignee: ten Haaft GmbH, Neulingen-Göbrichen (DE)

( * ) Notice: Subject to any disclaimer, the term of this patent is extended or adjusted under 35 U.S.C. 154(b) by 0 days.

(21) Appl. No.: 10/948,665

(22) Filed: Sep. 24, 2004

(65) Prior Publication Data

US 2005/0068238 A1 Mar. 31, 2005

(30) Foreign Application Priority Data

Sep. 26, 2003 (DE) ..... 203 14 930 U

(51) Int. Cl.
*H01Q 3/00* (2006.01)
*H01Q 19/12* (2006.01)

(52) U.S. Cl. ..... 343/757; 343/840

(58) Field of Classification Search ..... 343/757, 343/761, 840, 912
See application file for complete search history.

(56) References Cited

U.S. PATENT DOCUMENTS 4,266,179 A * 5/1981 Hamm, Jr. ..... 322/2 R
4,788,555 A 11/1988 Schultz et al.
5,528,250 A 6/1996 Sherwood et al.
6,016,120 A 1/2000 McNabb et al.
6,087,991 A 7/2000 Kustas
6,195,067 B1 * 2/2001 Gilger ..... 343/915
6,394,395 B1 5/2002 Poturalski et al.
6,478,261 B1 * 11/2002 Laraway et al. ..... 244/172.6
6,657,589 B1 * 12/2003 Wang et al. ..... 342/383

FOREIGN PATENT DOCUMENTS

| | | | |
|---|---|---|---|
| DE | 42 08 101 | A | 9/1993 |
| DE | 42 08 101 | A1 | 9/1993 |
| DE | 44 31 779 | A1 | 1/1996 |
| DE | 198 34 577 | A1 | 2/2000 |
| FR | 2 762 945 | A | 11/1998 |
| JP | 02 166807 | A | 6/1990 |
| JP | 05 248709 | A | 9/1993 |
| JP | 09 153712 | A | 6/1997 |

* cited by examiner

*Primary Examiner*—Shih-Chao Chen
(74) *Attorney, Agent, or Firm*—Browdy and Neimark, PLLC

(57) ABSTRACT

A satellite antenna station composed of: a dish for concentrating received electromagnetic energy; photovoltaic elements for supplying electric power to the station; and a positioning device controlled by a control unit. The positioning device is adjustable at least into a first position for optimizing reception of a signal from a satellite and into a second position for optimizing exposure of the photovoltaic elements to solar radiation.

6 Claims, 3 Drawing Sheets

SATELLITE ANTENNA WITH PHOTOVOLTAIC ELEMENTS FOR ELECTRIC POWER SUPPLY

BACKGROUND OF THE INVENTION

Satellite reception units consisting of a satellite antenna and corresponding receiver equipment are increasingly being used also for mobile applications, e.g., on vehicles such as motor homes. Each time such a unit is moved, which occurs frequently, it is necessary to optimally re-aim the generally small satellite antenna toward the satellite being received. In addition, at many locations there often is no line power supply available for the operation of the satellite reception unit.

DE 198 34 577 A1 discloses a special satellite antenna, consisting of many small individual antennas, that is dimensioned for motor homes. With the aid of GPS, the entire system can be swiveled by mechanical rotation into the desired direction for reception.

The problem of power supply availability is not addressed in this prior art.

DE 42 08 101 A discloses a stationary satellite reception unit, the parabolic reflector of which is designed not only for the usual purpose of bundling the incident rays onto the focal point, but in which the parabolic mirror additionally has a photovoltaic element affixed on it that directs the daylight, which impinges with greater or lesser intensity in the given satellite reception position of the reflector, to a battery that stores the electric energy to use it for the power supply to the satellite antenna and its associated reception components.

This solution has the shortcoming that the photovoltaic element on the reflector side may possibly impact the reception qualities for the satellite signal. The inevitable orientation of the satellite antenna toward the satellite accordingly has as a consequence that an optimization of the power supply generated by the photovoltaic element is not possible but occurs only as a by-product.

In the case of the receiving and reflector surfaces in mobile satellite reception units, which are generally made as small as possible, the solution according to this prior art does not have any advantages.

BRIEF SUMMARY OF THE INVENTION

The invention serves to optimize the basic concept of a dual purpose of a satellite antenna both for feeding a received satellite signal in the corresponding receiving equipment, as well as for producing solar energy, in such a way that an application to satellite antennas with small dimensions, especially for mobile applications, is made possible as well.

For this purpose, the invention provides a satellite antenna station comprising: a dish for concentrating received electromagnetic energy; photovoltaic elements for supplying electric power to the station; and a positioning device controlled by a control unit, wherein the positioning device is adjustable for moving the dish at least into a first position for optimizing reception of a signal from a satellite and into a second position for optimizing exposure of the photovoltaic elements to solar radiation.

The basic concept of the invention can thus be seen in the fact that the generally unutilized rear of the satellite antenna carries the photovoltaic elements and the adjustability of the reflector, primarily used to maximize the received signal, which is generally already provided in modern satellite reception units, is used to also attain a 2-axis optimization of the solar energy made available by the sun or daylight.

According to a preferred embodiment, the positioning device may cooperate with a navigation receiver (e.g., GPS), the location data from which can be utilized both for the adjustment of the satellite reception position, as well as for the adjustment of the solar ray reception position, and which thus also experiences a dual use.

BRIEF DESCRIPTION OF THE DRAWINGS

A preferred embodiment of the invention will now be explained in more detail with reference to the drawings, in which.

DETAILED DESCRIPTION OF THE INVENTION

Referring to FIGS. 1–5 a satellite antenna station according to the invention has a conventional parabolic or planar dish, or antenna 10. The reverse side of antenna 10, the side facing away from the signal reflecting side, is provided with a plurality of photovoltaic elements that form a solar module 10A. The front side of antenna 10 is provided with a reflecting surface or reflector 10B for reflecting satellite signals to a signal receiver or detector.

Antenna 10 is secured, at its front side, to the upper end 31A of a yoke 31.

The lower end 31B of yoke 31 is mounted to pivot about a horizontal swivelling axis H—H through a swivel angle, or elevation angle, β on a rotation unit 32 that is itself rotatable about a vertical axis V—V.

Rotation unit 32 is implemented as a base element, which can be attached, for example, to the roof of a structure such as a motor home.

By rotation of rotation unit 32 through a certain angle of rotation, or azimuth angle, a about the vertical axis V—V and swiveling of yoke 31 through a certain swivel angle β about the horizontal axis H—H, any orientation of the antenna toward a certain point in the sky is possible.

Figure 1A:
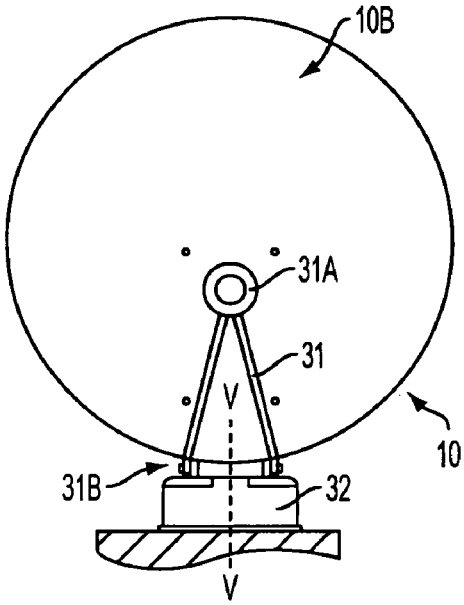
FIGS. 1A and 1B are front and rear views of a satellite antenna station according to the invention.
Figure 1B:
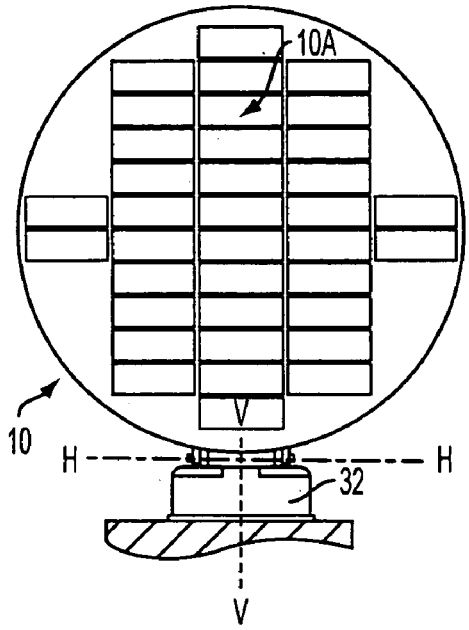
Figure 2:
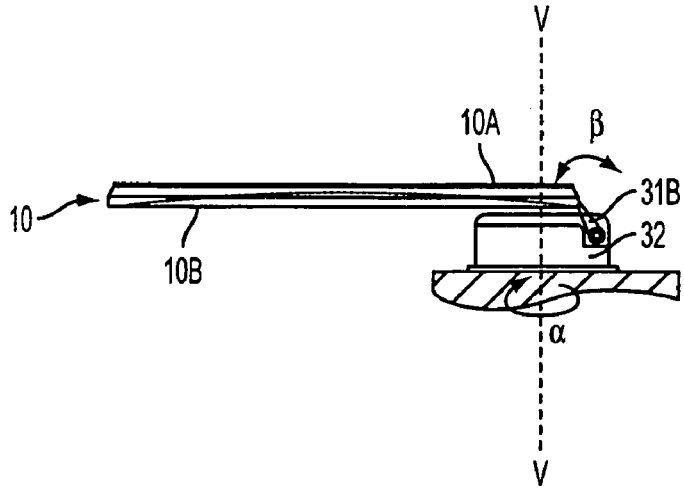
FIG. 2 is a side view of the satellite antenna station in a storage position.

In FIG. 2, the satellite antenna is shown in its idle, or storage position, in which it is folded down with the reflector side 10B and the solar module 10A is facing up, i.e., the satellite antenna is located in a horizontal position in which at least a generation of solar power by means of the photovoltaic elements of the solar module 10A is possible in dependence upon the position of the sun.

Figure 3:
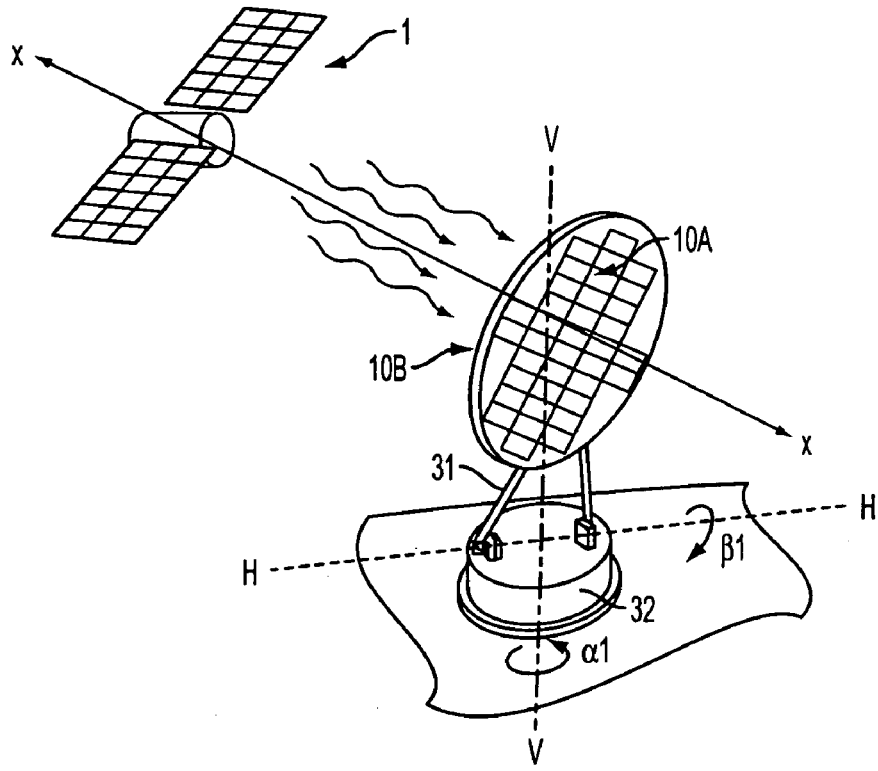
FIG. 3 is a first perspective view of the satellite antenna station in a first position for receiving a satellite signal.

FIG. 3 shows the inventive embodiment for adjusting the satellite antenna in the direction X-X in such a way that the signal transmitted by a geostationary satellite S impinges upon the reactor surface 10B in such a way that an optimization in the sense of a maximization of the received signal occurs. This first position (satellite mode) is thus characterized by a certain value β1 of the swivel angle about the horizontal axis H—H and the angle of rotation α1 about the vertical axis V—V.

Figure 4:
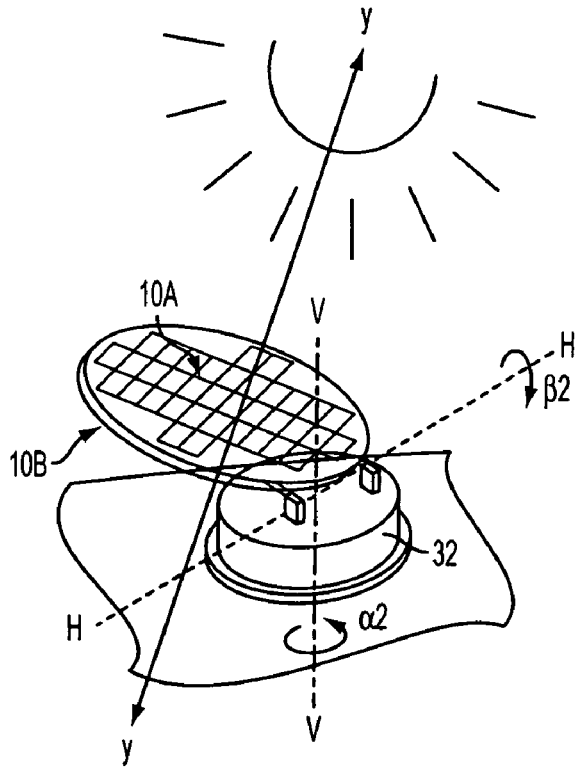
FIG. 4 is a second perspective view of the satellite antenna station in a second position for generating solar power.

In the position shown in FIG. 4, the solar module 10A is aimed in the direction Y-Y toward the sun, so that this second position (solar mode) is characterized by an appropriately selected swivel movement by a certain swivelling angle $\beta 2$ about the horizontal axis H—H and a rotation by a certain angle of rotation $\alpha 2$ about the vertical axis V—V.

Figure 5:
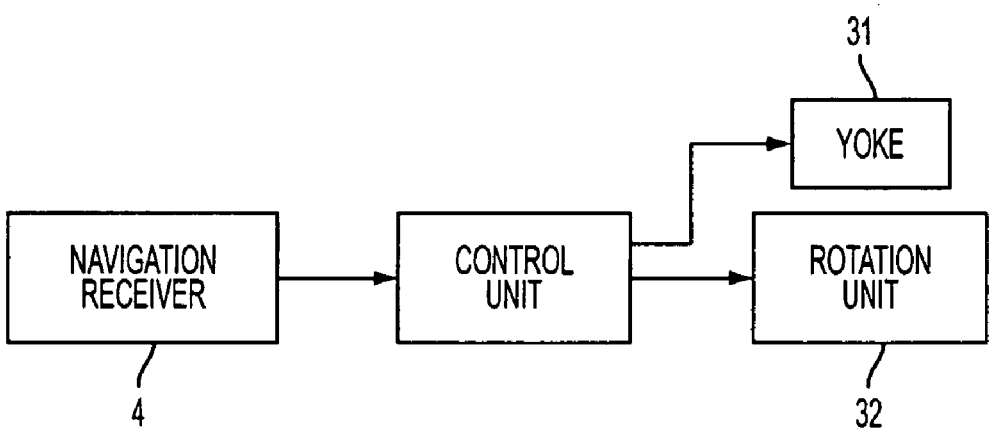
FIG. 5 is a block diagram of a system for controlling the position of the station.

The adjustment to either of the first and second positions may advantageously take place in such a way that, as shown in FIG. 5, movement of yoke 31 and rotation unit 32 is controlled by an associated control unit 41 that receives, from a navigation receiver 42, data identifying the exact location of the station. With this location data as a starting point, the angles $\alpha 1/\beta 1$ for the first position in the satellite mode, i.e., the orientation toward the satellite S that is associated with a desired TV station, may be computed with the use of appropriate tables or calibration values, and by selection of the angles $\alpha 2/\beta 2$ the second position in the solar mode, and by means of appropriate control signals to the rotation unit 32, the same may be rotated about the vertical axis V—V to the computed target angle $\alpha 1/\alpha 2$, and the satellite antenna 10 may be swiveled by an appropriate swiveling of the yoke 31 about the horizontal axis H—H to the computed target angle $\beta 1/\beta 2$.

The corresponding motors for this control system are not shown in the drawings. These motors and the hardware and software needed to properly orient antenna 10 are already well known in the art.

Based on the position data supplied by the navigation receiver, it is easily possible to perform an automatic change in position from one satellite to another (multiple positions in the satellite mode) with suitable formulas in the software of the receiver electronics.

In the second position (solar mode), an automatic tracking of the sun by the satellite antenna, for example in minute-steps, can be performed with the aid of appropriate tables or calibration values, wherein special sun or brightness sensors are no longer necessary due to the fact that the navigation receiver is used for this purpose as well.

Particularly advantageous in the inventive conception is the fact that the usage periods of the satellite mode and solar mode, which largely correspond to the time of day, overlap only to a small extent, so that a very economic overall solution in the sense of a continuous use of the satellite antenna has been found in this respect as well.

This application relates to subject matter disclosed in German Application Number 203 14 930.0, filed on Sep. 26, 2003, the disclosure of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A satellite antenna station comprising: a dish for concentrating received electromagnetic energy; photovoltaic elements for supplying electric power to said station; and a positioning device controlled by a control unit, wherein:

said positioning device is adjustable for moving said dish at least into a first position for optimizing reception of a signal from a satellite and into a second position for optimizing exposure of the photovoltaic elements to solar radiation;

said dish has a front side provided with a reflecting surface or reflector for reflecting electromagnetic radiation, and a rear side that faces away from said front side and that carries said photovoltaic elements in a position to generate power in response to radiation impinging on said rear side;

said positioning device comprises: a yoke having an upper end that holds said dish and a lower end; and a base element connected to said lower end for allowing said yoke to swivel about a horizontal axis under control of said control unit;

said dish is movable into a storage position associated with a swivelling angle of essentially zero degrees, in which position, said rear side faces upwardly to allow generation of solar power by said photovoltaic elements.

2. The satellite antenna station according to claim 1, wherein said base element comprises a rotation unit that is rotatable by said control unit about a vertical axis of rotation.

3. The satellite antenna station according to claim 2, wherein the first position is created by swivelling said yoke to an angle $\beta 1$ and rotating said rotation unit to an angle $\alpha 1$ for optimum satellite reception.

4. The satellite antenna station according to claim 2, wherein the second position is created by swivelling said yoke to an angle $\beta 2$ and rotating said rotation unit to an angle $\alpha 2$ for maximum reception of the solar radiation.

5. The satellite antenna station according to claim 1, further comprising a navigation receiver for supplying said control unit with data identifying the location of said station to determine at least the first position of said dish.

6. The satellite antenna station according to claim 5, wherein said navigation receiver also supplies said control unit with position data for determining the second position of said dish.

* * * * *